US009102159B2

(12) United States Patent
Suzuki

(10) Patent No.: US 9,102,159 B2
(45) Date of Patent: Aug. 11, 2015

(54) LIQUID SUPPLY DEVICE AND IMAGE FORMING APPARATUS

(71) Applicant: Kyosuke Suzuki, Kanagawa (JP)

(72) Inventor: Kyosuke Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/474,387

(22) Filed: Sep. 2, 2014

(65) Prior Publication Data

US 2015/0077462 A1 Mar. 19, 2015

(30) Foreign Application Priority Data

Sep. 13, 2013 (JP) ..... 2013-190612

(51) Int. Cl.
*B41J 2/175* (2006.01)

(52) U.S. Cl.
CPC ..... *B41J 2/175* (2013.01)

(58) Field of Classification Search
CPC ..... B41J 2/17509; B41J 2/17596; B41J 2/17556; B41J 2/17566; B41J 2/17523; B41J 2/17503; B41J 2/175; B41J 2/17553; B41J 2/17506; B41J 2/1755; B41J 29/38
USPC ..... 347/19, 84–86
See application file for complete search history.

(56) References Cited

U.S. PATENT DOCUMENTS

| | | | | |
|---|---|---|---|---|
| 6,666,549 | B2 | 12/2003 | Harada et al. | |
| 6,793,316 | B2 | 9/2004 | Sugimura et al. | |
| 7,837,292 | B2 | 11/2010 | Miyazawa | |
| 2010/0110119 | A1* | 5/2010 | Taga | 347/7 |
| 2012/0200644 | A1* | 8/2012 | Muto | 347/85 |

FOREIGN PATENT DOCUMENTS

| | | |
|---|---|---|
| JP | 2001-235002 | 8/2001 |
| JP | 2002-254677 | 9/2002 |
| JP | 3797548 | 7/2006 |
| JP | 2009-045900 | 3/2009 |
| JP | 2010-208164 | 9/2010 |

* cited by examiner

*Primary Examiner* — Thinh Nguyen
(74) *Attorney, Agent, or Firm* — Cooper & Dunham LLP

(57) ABSTRACT

A liquid supply device includes diaphragms, pressing members, a movement unit, a rotating shaft, and cams. In the liquid supply device, when the rotating shaft is rotated in a first direction, the cams are moved to arrange adjoining ones of the cams to have a phase difference around the rotating shaft, in which one of the cams selectively causes a corresponding one of the pressing members to regulate an increase in a volume of a corresponding one of the diaphragms. When the rotating shaft is rotated in a second direction, the cams are moved to arrange the cams in phase with one another when viewed from an axial direction of the rotating shaft, in which the cams simultaneously cause all the pressing members to regulate the increase in the volume of each of the diaphragms.

7 Claims, 17 Drawing Sheets

LIQUID SUPPLY DEVICE AND IMAGE FORMING APPARATUS

BACKGROUND OF THE INVENTION

1. Field of the Invention

The present invention relates to a liquid supply device adapted to supply liquid by an increase or decrease of a pump internal volume, and an image forming apparatus including the liquid supply device.

2. Description of the Related Art

Conventionally, a liquid supply device adapted to supply liquid by an increase or decrease of a pump internal volume utilizes a diaphragm pump including a diaphragm, a first check valve, and a second check valve, and the diaphragm being formed of an elastically deformable material to change the pump internal volume. The diaphragm pump includes a compression coil spring provided therein to actuate the diaphragm outward. The diaphragm pump further includes a pressing member provided to press the diaphragm from the outside toward the center of the diaphragm against the actuation force of the compression coil spring.

In the diaphragm pump, a volume of the diaphragm is decreased by pressing the diaphragm using the pressing member, so that liquid is ejected via the first check valve. By releasing the pressing member from the diaphragm, an internal pressure of the diaphragm is reduced due to the outward actuation force of the spring provided in the diaphragm, so that liquid is attracted via the second check valve. This diaphragm pump is commonly used in an inkjet recording apparatus as an ink supply unit to supply ink (liquid) from an ink tank (main tank) to a head tank (sub-tank).

For example, Japanese Patent No. 3797548 discloses an inkjet recording apparatus. In this inkjet recording apparatus, an ink tank and a head tank are connected to each other via an ink passage, and the ink passage is formed into an enclosed passage to which a diaphragm pump is connected. The inkjet recording apparatus includes plural recording heads each ejecting ink from the head tank. Each of the recording heads includes an ink tank, a diaphragm pump, a head tank, and an ink passage. The inkjet recording apparatus includes a pump drive device adapted to select one of the diaphragm pumps as a target diaphragm pump and drive the selected diaphragm pump. This pump drive device uses, as a pump drive source, a drive motor having a rotating shaft which is rotatable in forward and backward directions and is selectively connected to and drives the target diaphragm pump. The diaphragm pumps are disposed along a peripheral surface of the rotating shaft and arranged in a line substantially parallel to an axial direction of the rotating shaft.

FIGS. 16A to 16D are diagrams for explaining the operation of a pump drive device 400 disclosed in Japanese Patent No. 3797548. As shown in FIGS. 16A to 16D, the pump drive device 400 includes a first link 402 and a second link 403 for each of the diaphragm pumps. The first link 402 includes a first tooth portion 401 with plural teeth formed at an edge of an end portion of the first link 402. The second link 403 is adapted to change the volume of the diaphragm pump due to an up/down movement of the second link 403 caused by engagement with the first link 402. The first link 402 is rotatably supported on the device and disposed to face a peripheral surface of a rotating shaft 404 of a drive motor, and supporting shafts of the first link 402 are arranged in parallel with an axial direction of the rotating shaft. The second link 403 includes a pressing member 406 adapted to press a diaphragm 405 in a contraction direction of the diaphragm 405, and an end portion of the second link 403 is movably connected to an end portion of the first link 402 which is opposite to the end portion thereof where the first tooth portion 401 is formed. The second link 403 is subject to an up/down movement in a direction indicated by the arrow C or the arrow F in FIGS. 16A to 16D while the movement of the second link 403 is regulated by a pin 403*a*. Moreover, the second link 403 is actuated by a compression coil spring (first spring) 407 in a direction to approach the diaphragm 405. The pressing member 406 of the second link 403 presses the diaphragm 405 such that ink is not extruded from the diaphragm 405 by the actuation force of the first spring 407. A second tooth portion 408 with plural teeth is formed on the peripheral surface of the rotating shaft 404 of the drive motor, and the teeth of the second tooth portion 408 are selectively engaged with the teeth of the first tooth portion 401 of the first link 402. The second tooth portion 408 is disposed on the peripheral surface of the rotating shaft 404 of the drive motor in a position in the circumferential direction to face the first tooth portion 401. When viewed from the axial direction of the rotating shaft 404, the second tooth portions 408 of the diaphragm pumps are arranged in the positions at mutually different phase angles. A compression coil spring (second spring) 409 is provided within the diaphragm 405 to actuate the diaphragm 405 outward.

In the above-described pump drive device 400, a selection operation is performed to select one of the diaphragm pumps 410 as a target diaphragm pump, and a drive operation is performed to drive the target diaphragm pump 410 so as to supply ink.

Here, a state of the pump drive device 400 in which the first tooth portion 401 and the second tooth portion 408 are not engaged with each other is referred to as an "initial state". In the initial state of the pump drive device 400, rotation of the rotating shaft 404 is started in the direction indicated by the arrow A in FIG. 16A. The rotating shaft 404 is rotated until the first link 402 corresponding to the target diaphragm pump 410 is engaged with the first tooth portion 401. Rotation of the first link 402 which is engaged with the first tooth portion 401 is started in the direction indicated by the arrow B in FIG. 16A, and actuation of the second link 403 is started in the direction indicated by the arrow C in FIG. 16A. If the rotating shaft 404 is further rotated in the direction indicated by the arrow A in FIG. 16A, the first link 402 is further rotated in the direction indicated by the arrow B in FIG. 16A and the second link 403 is further actuated in the direction indicated by the arrow C in FIG. 16A. By this actuation, the second link 403 is actuated in the direction indicated by the arrow C in FIG. 16B. If the first tooth portion 401 of the first link 402 with which the second tooth portion 408 of the rotating shaft 404 is engaged does not correspond to the target diaphragm 405, the rotation of the rotating shaft 404 in the direction indicated by the arrow A in FIG. 16B is continued until the second tooth portion 408 of the rotating shaft 404 is engaged with the first tooth portion 401 of the first link 402 corresponding to the target diaphragm 405. This operation causes the target diaphragm 405 to be selected.

After the target diaphragm 405 is selected, if the rotating shaft 404 is rotated in the direction indicated by the arrow D in FIG. 16C, rotation of the first link 402 is started in the direction indicated by the arrow E in FIG. 16C and actuation of the second link 403 is started in the direction indicated by the arrow F in FIG. 16C. If the rotating shaft 404 in this state is further rotated in the direction indicated by the arrow D in FIG. 16C, the first link 402 is further rotated in the direction indicated by the arrow E in FIG. 16C and the second link 403 is further actuated in the direction indicated by the arrow F in FIG. 16C. By this actuation, the pressing member 406 of the second link 403 presses the diaphragm 405 in the contracting direction of the diaphragm 405 while resisting the force of the second spring 409. Hence, the volume of the diaphragm 405 is reduced and the ink in the diaphragm 405 is supplied to the head tank (not illustrated). If the rotating shaft 404 in this state is rotated in the direction indicated by the arrow A in FIG. 16A, the first link 402 is rotated in the direction indicated by the arrow B in FIG. 16A and the second link 403 is actuated in the direction indicated by the arrow C in FIG. 16A. By this actuation, the pressing member 406 of the second link 403 is moved and no longer presses the diaphragm 405, and the volume of the diaphragm 405 is increased according to the actuation force of the first spring 407. This operation may attract ink in the ink tank (not illustrated) into the diaphragm 405.

Incidentally, if the rotating shaft 404 is rotated in the direction indicated by the arrow D in FIG. 16C until the engagement between the second tooth portion 408 of the rotating shaft 404 and the first tooth portion 401 of the first link 402 is cancelled, the target diaphragm may be changed to another diaphragm or the pump drive device 400 may be set in the initial state. In this initial state, the pressing member 406 of the second link 403 presses the diaphragm 405 lightly such that ink is not extruded from the diaphragm 405 by the actuation force of the first spring 407.

However, in the pump drive device disclosed in Japanese Patent No. 3797548, the diaphragm 405 tends to be increased in the volume due to the use of the second spring 409 provided in the diaphragm 405 to actuate the diaphragm 405 outward. If the volume of the diaphragm 405 is decreased with the consumption of ink, the internal space of the diaphragm 405 is subject to negative pressure. In such a condition, the increase in the volume of the diaphragm 405 by the actuation force of the second spring 409 is not regulated. For example, if the ink tank is removed and the diaphragm 405 is opened to the atmosphere when the second link 403 is moved downward as shown in FIG. 16B or when the rotating shaft 404 is in the initial position, it is likely that external air is attracted into the diaphragm 405. For example, if the second tooth portion 408 of the rotating shaft 404 associated with the target diaphragm corresponding to the ink tank to be removed should be engaged with the first tooth portion 401 of the first link 402 and the target diaphragm should be pressed by the pressing member of the second link as shown in FIGS. 16A, 16C and 16D in the above-mentioned condition in order to regulate the increase in the volume of the diaphragm 405, external air may not be attracted into the diaphragm even when the ink tank is removed.

However, the liquid supply device disclosed in Japanese Patent No. 3797548 is arranged so that only the target diaphragm among the plural diaphragms 405 is pressed by the pressing member of the second link. If an ink tank corresponding to another diaphragm 405 in which the increase in the volume is not regulated is removed erroneously, external air enters that diaphragm. The air once introduced in the wrong diaphragm cannot be ejected from the side of the ink tank where the first check valve is disposed. The air introduced in the wrong diaphragm must be ejected from the side of the recording head together with ink. As a result, the ink used to eject the air in this manner will be wasted unnecessarily.

SUMMARY OF THE INVENTION

In one aspect, the present invention provides a liquid supply device which is adapted to prevent attraction of air into the liquid holding parts due to a negative pressure by regulating the increase in the volume of each of the liquid holding parts simultaneously.

In an embodiment which solves or reduces one or more of the above-described problems, the present invention provides a liquid supply device including a plurality of liquid holding parts each holding liquid, formed of an elastically deformable material, and adapted to be increased in a volume of the liquid holding part by an outward actuation force of a spring provided in the liquid holding part; a plurality of regulation units each adapted to regulate an increase in a volume of a corresponding one of the plurality of liquid holding parts; a movement unit adapted to move the plurality of regulation units to a position where the increase in the volume of at least one of the plurality of liquid holding parts is regulated by the plurality of regulation units; a rotating shaft adapted to be rotated in one of first and second directions; and a plurality of drive transmission units disposed on a peripheral surface of the rotating shaft in positions corresponding to the plurality of regulation units, wherein the movement unit is adapted to move the plurality of drive transmission units when the rotating shaft is rotated in the first direction so that adjoining ones of the plurality of drive transmission units are arranged to have a phase difference around the rotating shaft when viewed from an axial direction of the rotating shaft, wherein one of the plurality of drive transmission units selectively causes a corresponding one of the plurality of regulation units to regulate the increase in the volume of a corresponding one of the plurality of liquid holding parts, and move the plurality of drive transmission units when the rotating shaft is rotated in the second direction so that the plurality of drive transmission units are arranged in phase with one another when viewed from the axial direction of the rotating shaft, wherein the plurality of drive transmission units simultaneously cause all the plurality of regulation units to regulate the increase in the volume of each of the plurality of liquid holding parts.

Other objects, features and advantages of the present invention will become more apparent from the following detailed description when read in conjunction with the accompanying drawings.

DETAILED DESCRIPTION OF THE PREFERRED EMBODIMENTS

A description will be given of embodiments with reference to the accompanying drawings.

Figure 1:
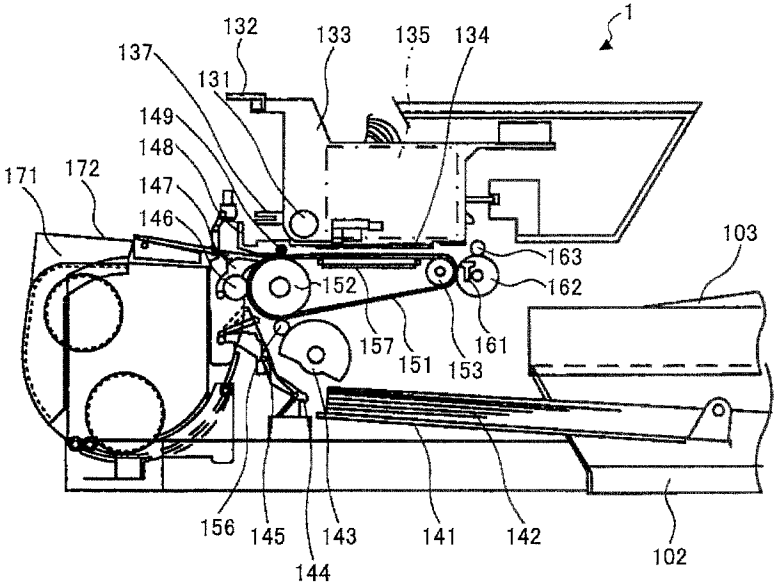
FIG. 1 is a side view of a mechanical part of an inkjet recording apparatus as an image forming apparatus according to an embodiment.
Figure 2:
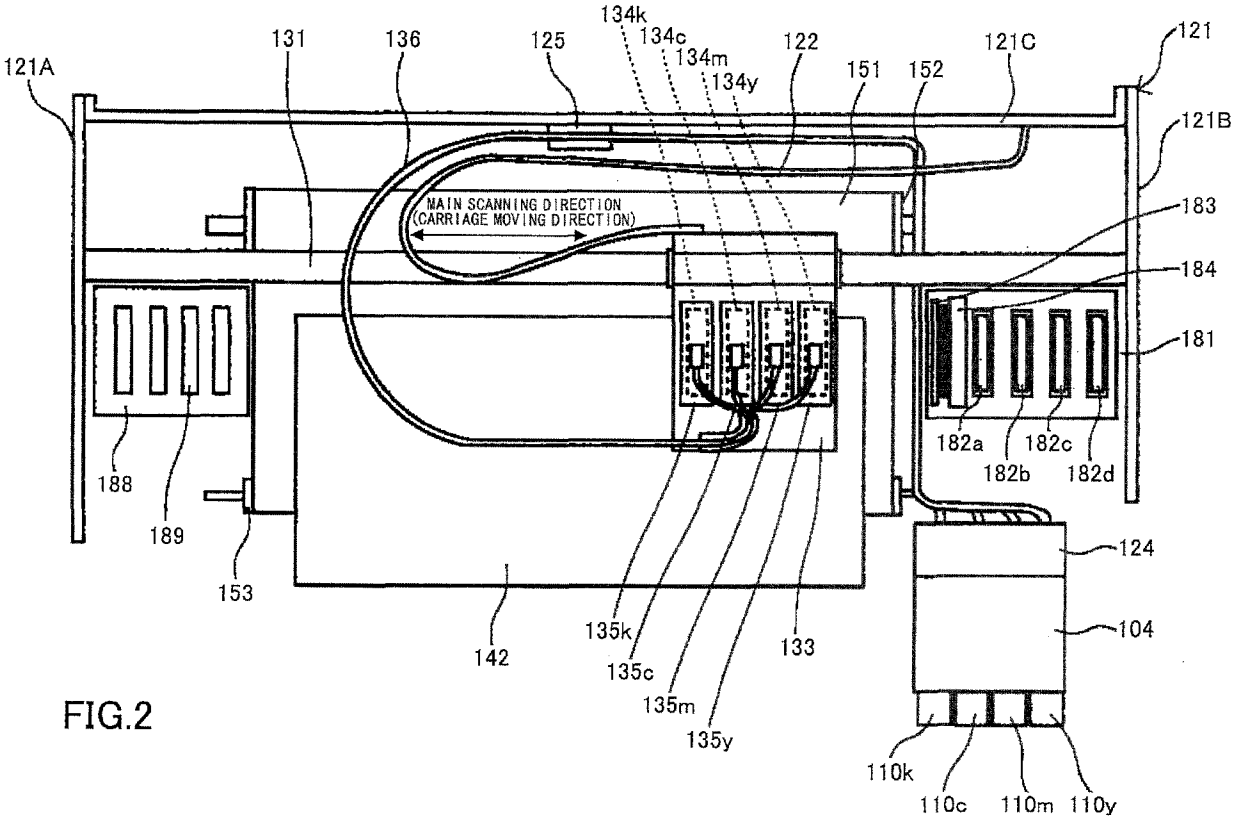
FIG. 2 is a plan view of the mechanical part of the inkjet recording apparatus as the image forming apparatus according to the embodiment.

First, a configuration of an inkjet recording apparatus which is an example of an image forming apparatus according to an embodiment is explained. FIG. 1 is a side view of a mechanical part of an inkjet recording apparatus 1. FIG. 2 is a plan view of the mechanical part of the inkjet recording apparatus 1.

As shown in FIGS. 1 and 2, the inkjet recording apparatus 1 includes left and right side plates 121A and 121B which form a frame 121. In the mechanical part of the inkjet recording apparatus 1, a guide rod 131 and a stay 132 are transversely extending guide members, and end portions of these guide members are secured to the side plates 121A and 121B. A carriage 133 is held on the guide rod 131 and the stay 132 to be movable in a main scanning direction. The carriage 133 is moved by a main scanning motor (not illustrated) through a timing belt in one of bidirectional main scanning directions (or carriage moving directions) indicated by the arrow in FIG. 2.

On the carriage 133, a recording head 134 including four recording heads 134*k*, 134*c*, 134*m* and 134*y* is mounted, and the recording heads 134*a*-134*d* are arrayed in a line extending in a direction perpendicular to the main scanning directions. The recording heads 134*k*, 134*c*, 134*m*, and 134*y* are provided to eject ink droplets of respective colors of black (K), cyan (C), magenta (M), and yellow (Y) with the ink ejection surfaces of the recording heads being directed downward. Alternatively, the recording head 134 may be a single recording head including four nozzle members having nozzles for ejecting ink droplets of the four colors.

The inkjet head which constitutes the recording head 134 may employ, as a pressure generation unit to generate a pressure for ejecting ink droplets, any of a piezoelectric actuator using piezoelectric elements, a thermal actuator utilizing a phase change due to liquid film boiling because of electric conversion elements, such as heating resistors, a shape memory alloy actuator utilizing a metallic phase change due to temperature changes, an electrostatic actuator utilizing electrostatic force, etc.

Moreover, on the carriage 133, head tanks 135*k*, 135*c*, 135*m* and 135*y* are mounted for supplying the inks of the four colors to the recording heads 134*k*, 134*c*, 134*m* and 134*y*, respectively. The four-color inks from ink cartridges 110*k*, 110*c*, 110*m* and 110*y* (which are arranged in an ink cartridge loading portion 104) are respectively supplied to the head tanks 135*k*, 135*c*, 135*m* and 135*y* through flexible ink supply tubes 136. In the ink cartridge loading portion 104, an ink supply pump unit (ink supply device) 124 for supplying the ink from each ink cartridge 110 is arranged. An intermediate part of each ink supply tube 136 is held on a rear plate 121C (which constitutes a part of the frame 121) by a locking member 125.

A semicircular sheet feeding roller 143 and a separation pad 144 are arranged as a sheet feeding unit. The sheet feeding unit serves to pick up one of sheets 142 loaded on a sheet loading plate (pressurizing plate) 141 of a sheet feeding tray 102 shown in FIG. 1, and sends the sheet 142 to a sheet guiding unit. The sheet feeding roller 143 and the separation pad 144 are facing each other to perform separation of one sheet from the sheets 142 loaded on the sheet loading plate 141 and feeding of the one sheet. The separation pad 144 is made of a friction material with a high coefficient of friction. The separation pad 144 is actuated toward the sheet feeding roller 143 side.

In order to transport the sheet 142 sent from the sheet feeding unit to a location beneath the recording head 134, a guide member 145, a counter roller 146, a conveyance guide member 147, and a pressing member 148 having a front-end pressurizing roller 149 are provided as a sheet guiding unit to guide the transport of the sheet 142. Furthermore, a transporting belt 151 is provided as a transporting unit for electrostatically attracting the sheet 142 sent from the sheet feeding unit and transporting the attracted sheet 142 in a vicinity of the location beneath the recording head 134. In the following, the material of the recording medium is not limited to paper, and the recording medium used in the image forming apparatus according to the present invention may include paper, yarn, fibers, textile, leather, metal, plastics, glass, wood, and ceramics.

The transporting belt 151 is implemented by an endless-type belt, and this transporting belt 151 is wound between a conveyance roller 152 and a tension roller 153 and arranged so that the transporting belt 151 is rotated in a belt transporting direction (which is a sub-scanning direction perpendicular to the main scanning direction). Moreover, a charging roller 156 is disposed to contact a surface of the transporting belt 151, and this charging roller 156 serves as a charging unit for electrostatically charging the surface of the transporting belt 151. The charging roller 156 is arranged so that the charging roller 156 is rotatable and follows the rotation of the transporting belt 151. Furthermore, a guide member 157 is disposed on a back surface of the transporting belt 151 at a position corresponding to a recording area by the recording head 134.

The transporting belt 151 is rotated in the belt transporting direction through the conveyance roller 152 which is rotated in a controlled timing by a sub-scanning motor which is not illustrated.

Further, as a sheet output unit to output the sheet 142 on which an image is recorded by the recording head 134, a separation claw 161, a sheet ejecting roller 162, and a delivery roller 163 are provided. The separation claw 161 is provided to separate the sheet 142 from the transporting belt 151. A sheet output tray 103 is disposed under the sheet ejecting roller 162.

Moreover, a duplex unit 171 is detachably attached to a rear portion of a main body 101 of the inkjet recording apparatus 1. The duplex unit 171 receives the sheet 142 which is returned by the reverse rotation of the transporting belt 151, inverts the received sheet 142, and sends the inverted sheet 142 again to the location between the counter roller 146 and the transporting belt 151. An upper surface of the duplex unit 171 is formed into a manual bypass tray 172.

As shown in FIG. 2, in a non-recording area on one side of the carriage 133 in the main scanning direction, a maintenance recovery device 181 is disposed. The maintenance recovery device 181 includes a recovery unit which maintains and recovers the state of ink ejection of the recording head 134.

In the maintenance and recovery device 181, cap members 182*a*-182*d* (which are collectively called "caps" 182) to perform capping of the respective nozzle surfaces of the recording head 134, a wiper blade 183 (which is a blade member to perform wiping of the nozzle surfaces, and a draining ejection container 184 are provided. When performing draining ejection in which liquid droplets which are not related to recording are ejected from the nozzles of the recording head 134, the draining ejection container 184 receives liquid droplets. In this embodiment, the cap 182*a* is used as an attraction and moisturizing cap and the other caps 182*b*-182*d* are used as moisturizing caps.

In the inkjet recording apparatus 1, the waste ink produced in a maintenance recovery operation by the maintenance recovery device 181, the ink stored in the caps 182, the ink removed from the wiper blade 183 by a wiper cleaner (not illustrated), and the ink provided in the draining ejection and stored in the draining ejection container 184 are collected and accommodated in a waste liquid tank (not illustrated).

Further, as shown in FIG. 2, in a non-recording area on the other side of the carriage 133 in the main scanning direction, a draining ejection container 188 is also provided. When performing the draining ejection in order to eliminate the thickened recording liquid in the nozzles of the recording head, the draining ejection container 188 receives the liquid droplets. In the draining ejection container 188, plural openings 189 are formed to face the nozzles arrayed in the nozzle surfaces of the recording head 134.

In the inkjet recording apparatus 1 according to this embodiment, one of the sheets 142 contained in the sheet feeding tray 102 is separated and the sheet 142 is fed upward from the sheet feeding tray 102 and guided by the guide member 145. The sheet 142 is inserted between the transporting belt 151 and the counter roller 146 and transported, and the front end of the sheet 142 is guided by the conveyance guide member 147 and pressed on the transporting belt 151 by the front-end pressurizing roller 149. The transporting direction of the sheet 142 is changed by about 90 degrees to the horizontal direction with the rotation of the transporting belt 151.

At this time, an AC voltage is present in which a positive charging voltage level and a negative charging voltage level are alternately supplied from an AC bias supply unit of the inkjet recording apparatus 1 to the charging roller 156. The surface of the transporting belt 151 is electrostatically charged by the charging roller 156 to include a belt-like portion in which positively charged areas and negatively charged areas are alternately provided at predetermined intervals in the sub-scanning direction.

When the sheet 142 is sent to the transporting belt 151, the sheet 142 is electrostatically attracted to the transporting belt 151 and transported in the sub-scanning direction in accordance with the rotation of the transporting belt 151.

When the carriage 133 is moved in the main scanning direction based on the scanning positional information output by a linear encoder 137, the recording head 134 is driven in accordance with an image signal to eject ink droplets to the sheet 142 in a stopped condition, so that an image is recorded on the sheet 142 by one line. Subsequently, after the sheet 142 is moved in the sub-scanning direction by a predetermined amount, an image is recorded on the sheet 142 on the following line. When a recording end signal or a detection signal indicating arrival of a rear end of the sheet 142 at an end of the recording area is received, the inkjet recording apparatus 1 terminates the image recording operation and transports the sheet 142 to the sheet output tray 103.

When the inkjet recording apparatus 1 is in a standby state (before recording), the carriage 133 is moved to the side of the maintenance recovery device 181, capping of the nozzles of the recording head 134 is performed by the caps 182 of the maintenance recovery device 181, and insufficient ejection due to ink desiccation is prevented by maintaining the nozzles in a moistened condition. In addition, when capping of the nozzles of the recording head 134 is performed by the caps 182, a recovery operation is performed in which the recording liquid is attracted from the nozzles by an attraction pump (which is not illustrated) in order to eliminate the thickened recording liquid and air bubbles from the recording head 134 (which is referred to as "nozzle attraction" or "head attraction"). Further, before a recording job is started or during a recording job, a draining ejection operation in which ink droplets, not related to image formation or recording, are ejected from the recording head 134 is performed, so that stable liquid ejection performance of the recording head 134 is maintained.

Figure 3:
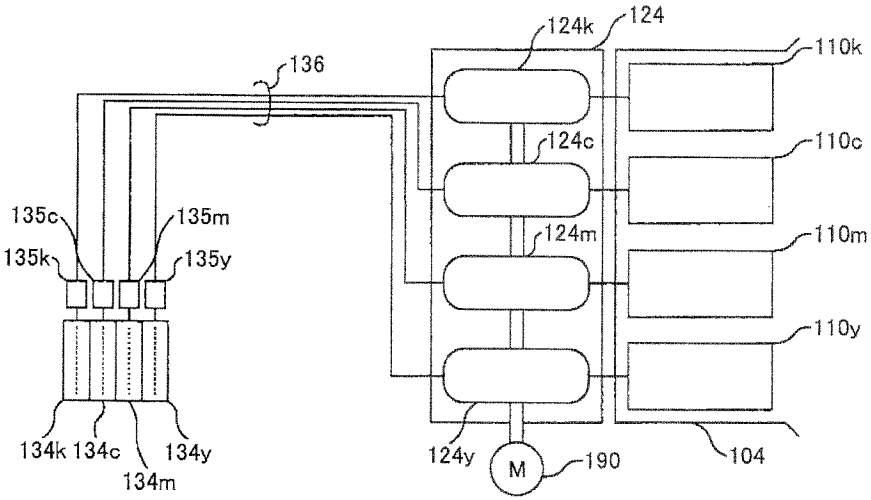
FIG. 3 is a diagram showing a configuration of an ink supply pump unit.

Next, a configuration of the ink supply pump unit 124 in the inkjet recording apparatus 1 is explained with reference to FIG. 3. FIG. 3 is a diagram showing a configuration of the ink supply pump unit 124.

As shown in FIG. 3, the ink supply pump unit 124 includes ink supply devices 124*k*, 124*c*, 124*m* and 124*y*. The head tanks 135*k*, 135*c*, 135*m* and 135*y* are provided to supply inks of four colors of black, cyan, magenta and yellow to the recording heads 134*k*, 134*c*, 134*m* and 134*y*, respectively. The ink cartridges 110*k*, 110*c*, 110*m* and 110*y* are arranged in the ink cartridge loading portion 104 of the inkjet recording apparatus 1. The four-color inks from the ink cartridges 110*k*, 110*c*, 110*m* and 110*y* are supplied to the head tank 135*k*, 135*c*, 135*m* and 135*y* via the flexible ink supply tubes 136 by the ink supply devices 124*k*, 124*c*, 124*m* and 124*y*, respectively. Moreover, as shown in FIG. 3, the ink supply devices 124*k*, 124*c*, 124*m* and 124*y* are driven by a drive motor 190 as a common drive source.

Figure 4A:
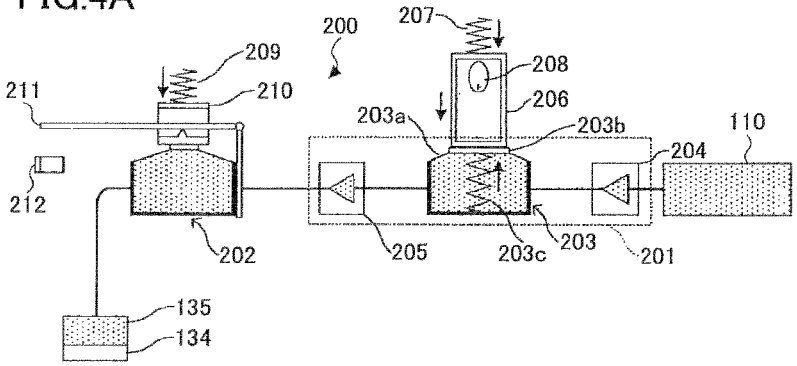
FIGS. 4A and 4B are diagrams showing a configuration of an ink supply device as a liquid supply device according to an embodiment.
Figure 4B:
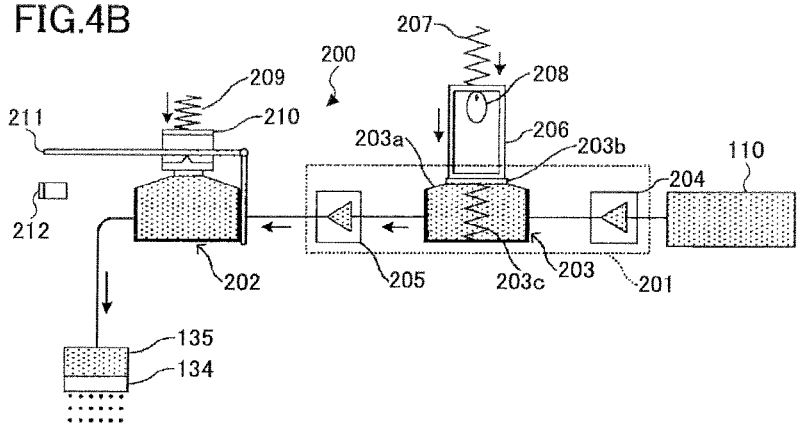
Figure 6A:
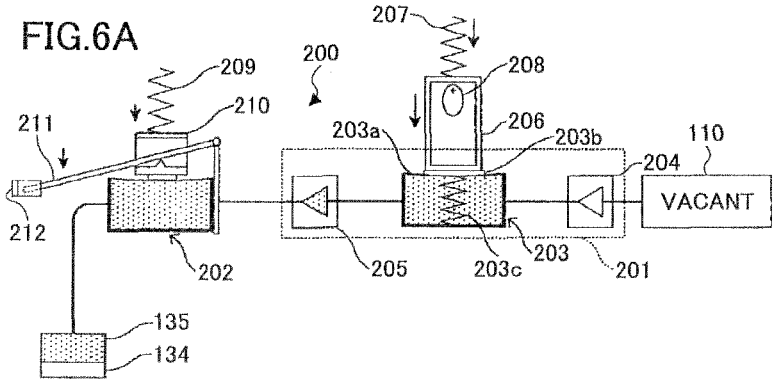
FIGS. 6A to 6C are diagrams for explaining an inappropriate operation of an ink supply device as a comparative example upon occurrence of an ink end state.
Figure 6B:
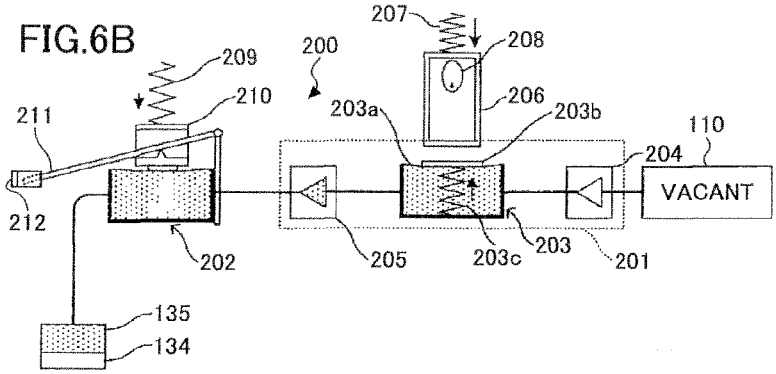
Figure 6C:
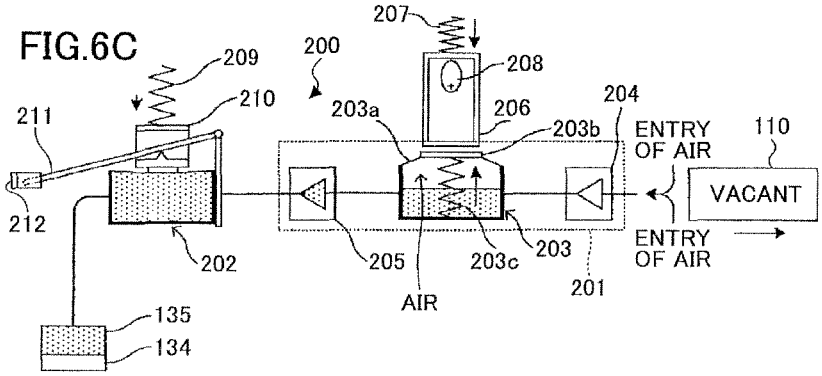

FIGS. 4A and 4B are diagrams showing a configuration of an ink supply device 200 according to an embodiment. The ink supply device 200 shown in FIGS. 4A and 4B is an example of the ink supply devices 124*k*-124*y* in the ink supply pump unit 124 of the inkjet recording apparatus 1. The ink supply device 200 includes a diaphragm pump 201 and a pressure buffer 202. The diaphragm pump 201 includes a pressurizing pump 203, a first check valve 204 disposed on an upstream side of the pressurizing pump 203, and a second check valve 205 disposed on a downstream side of the pressurizing pump 203. The pressurizing pump 203 includes a diaphragm 203*a*, a pump seat 203*b*, and a spring 203*c*. The diaphragm 203*a* is made of an elastically deformable material, such as a flexible resin, and a pump internal volume of the diaphragm pump 201 is changeable with the diaphragm 203*a* material and the spring 203*a*. The pump seat 203*b* is provided inside the diaphragm 203*a*. The spring 203*c* is arranged to actuate the diaphragm 203*a* via the pump seat 203*b* upward. Moreover, a pressing member 206 is mounted on the diaphragm 203*a* of the pressurizing pump 203 and provided to press the diaphragm 203*a* downward using an actuation force of a spring 207 disposed on the top of the pressing member 206. The pressure buffer 202 is provided to stabilize the liquid supply by the diaphragm pump 201 by applying a predetermined pressure to the head tank 135 through the ink supply tube 136. A pressing member 210 is mounted on an upper portion of the pressure buffer 202 and provided to press the pressure buffer 202 downward using an actuation force of a spring 209 disposed on the top of the pressing member 210. An elastic actuation force of the spring 207 is larger than an elastic actuation force of the spring 209. The elastic actuation force of the spring 207 is larger than an elastic actuation force of the spring 203*c*. The pressing member 210 is formed to have a generally C-shaped cross-section perpendicular to the transverse direction in FIGS. 4A and 4B, and a front-side end surface, a right-side end surface, and a left-side end surface of the pressing member 210 are hollow and open to the atmosphere. The pressing member 210 includes a connection part formed on an internal bottom surface of the pressing member 210, and this connection part is in contact with an ink end detection filler 211 which is provided to detect an ink end state of the ink cartridge 110. As shown in FIGS. 6A to 6C (which will be described later), if a volume of the pressure buffer 202 is reduced and a position of the upper portion of the pressure buffer 202 is lowered, then a position of the pressing member 210 is also lowered in accordance with the downward movement of the pressure buffer 202. By the downward movement of the pressing member 210, the tip of the ink end detection filler 211 is lowered because a horizontal half portion of the filler 211 is pivoted around an intermediate point between the horizontal half portion and a vertical half portion of the filler 211. An optical sensor 212 is disposed at a predetermined position where an ink end state of the ink cartridge is detected. When the tip of the ink end detection filler 211 passes through a detection area of the optical sensor 212 due to the lowering of the tip of the ink end detection filler 211, the optical sensor 212 outputs a detection signal to a host apparatus, so that the host apparatus may recognize occurrence of an ink end state of the ink cartridge.

Next, an ink supply operation of the ink supply device as the liquid supply device according to the embodiment is explained with reference to FIGS. 4A through 5C.

As shown in FIG. 4A, it is assumed that all of the ink cartridge 110, the pressurizing pump 203, the pressure buffer 202, and the head tank 135 are substantially full of ink. At this time, a cam 208 is rotated by a drive motor which is not illustrated. When the supply of ink is demanded such as for the maintenance recovery of the recording head or for the image recording, it is necessary to perform an ink supply operation of the ink supply device and the drive motor is continuously rotating the cam 208. The pressing member 206 presses the diaphragm 203*a* downward in FIG. 4A or presses the diaphragm 203*a* toward the center of the diaphragm 203*a* because of the actuation force of the spring 207 which is larger than the actuation force of the spring 203*c*. When the liquid ejection of the recording head is not performed and the consumption of ink does not arise, the position of the pressing member 206 remains unchanged. As shown in FIG. 4B, if ink is ejected from the recording head 134 and the ink in the head tank 135 is reduced, the ink is supplied from the pressure buffer 202 to the head tank 135 to supplement the amount of the ink being consumed. As the ink in the pressure buffer 202 is reduced, the diaphragm 203*a* is pressed downward by the pressing member 206 due to the actuation force of the spring 207 which is larger than the actuation force of the spring 209 provided for the pressure buffer 202, and the ink in the pressurizing pump 203 is supplied to the pressure buffer 202. Unless the ink cartridge 110 becomes vacant, the ink in the pressure buffer 202 is barely reduced. At this time, the tip of the ink end detection filler 211 provided on the pressure buffer 202 is not detected by the optical sensor 212. The elastic actuation forces of the spring 207 and the spring 209 are set up so that the meniscus formed in the nozzles (not illustrated) of the recording head 134 is not affected. If the ink in the pressure buffer 202 is reduced as shown in FIG. 4B, the diaphragm 203*a* is pressed downward by the pressing member 206 due to the elastic actuation force of the spring 207, and the ink is supplied from the diaphragm 203*a* to the pressure buffer 202 via the check valve 205 according to the amount of the ink reduced in the pressure buffer 202.

Figure 5A:
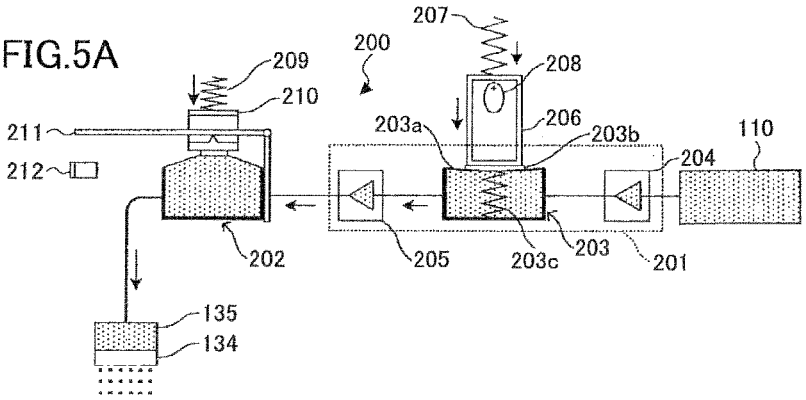
FIGS. 5A to 5C are diagrams showing the configuration of the ink supply device as the liquid supply device according to the embodiment.
Figure 5B:
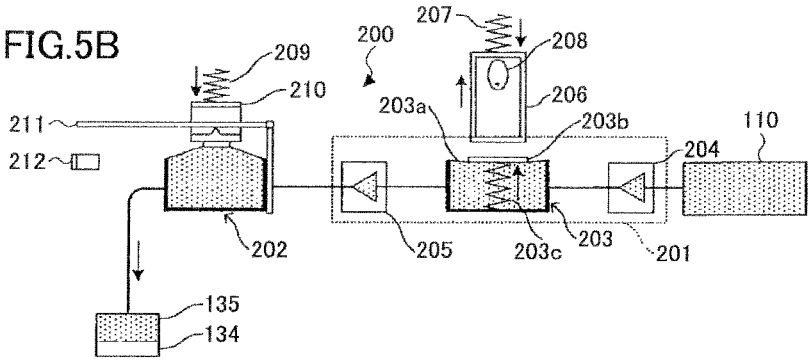
Figure 5C:
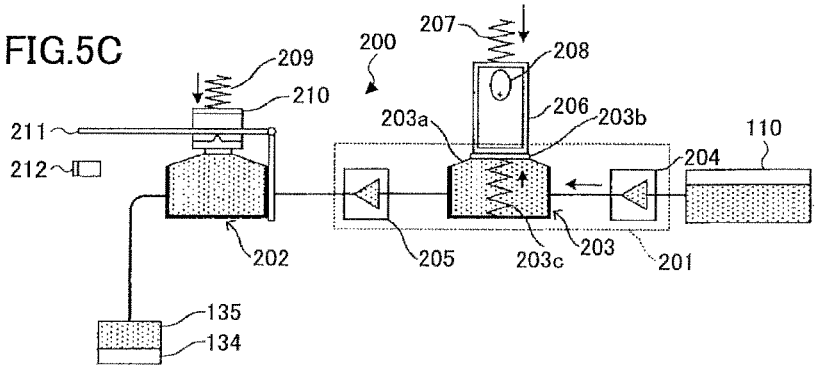

If ink is further ejected from the recording head 134 as shown in FIG. SA, the ink in the head tank 135 is reduced, and the ink is similarly supplied from the pressure buffer 202 to the head tank 135 according to the amount of the ink reduced in the head tank 135. Moreover, the ink is supplied from the diaphragm 203*a* to the pressure buffer 202 via the check valve 205 according to the amount of the ink reduced in the pressure buffer 202. When the pressing member 206 is lowered to a position where the ink in the diaphragm 203*a* is no longer supplied to the pressure buffer 202, ink is attracted from the ink cartridge 110 to the diaphragm 203*a* via the check valve 204 as shown in FIG. 58B. The cam 208 at this time is rotated around its rotating shaft to be in contact with the pressing member 206, and the cam 208 is located at its top dead center to raise the pressing member 206 from the diaphragm 203*a*. As shown in FIG. 5C, due to the outward actuation force of the spring 203*c* provided in the diaphragm 203*a*, the diaphragm 203*a* is actuated upward and the volume of the diaphragm 203*a* is increased. As a result, the internal space of the diaphragm 203*a* is subject to negative pressure, an attraction force works at this time, and the ink in the ink cartridge 110 is attracted to the diaphragm 203*a* via the check valve 204. Unless the ink cartridge 110 becomes vacant, the tip of the ink end detection filler 211 is not detected by the optical sensor 212 even when the ink in the pressure buffer 202 is reduced.

Next, an inappropriate operation of an ink supply device as a comparative example is explained. FIGS. 6A to 6C are diagrams for explaining an inappropriate operation of the ink supply device upon occurrence of an ink end state.

As shown in FIG. 6A, the ink cartridge 110 becomes vacant with the consumption of ink. When the optical sensor 212 detects the tip of the ink end detection filler 211, it is determined that the ink cartridge becomes vacant, based on the detection signal output by the optical sensor 212. If a stop position of the cam 208 at this time is the bottom dead center as shown in FIG. 6A, the negative pressure state in the ink passage of the diaphragm pump 201 is maintained even when the ink cartridge 110 is removed for replacement with the new one. Hence, external air does not enter the ink passage of the diaphragm pump 201. However, if the stop position of the cam 208 at this time is the top dead center as shown in FIG. 6B, the pressing member 206 separates from the pump seat 203*b* and it is impossible to maintain the negative pressure state in the ink passage of the diaphragm pump 201. In this case, as shown in FIG. 6C, if the vacant ink cartridge 110 is removed for replacement, external air enters the ink passage of the diaphragm pump 201 via the check valve 204. As a result, the air included in the diaphragm pump 201 is supplied to the recording head with ink, which may cause a non-ejection problem at a time of image recording. Or a maintenance recovery of the recording head must be performed to eject the air included in the diaphragm pump 201 from the recording head with ink. The ink used to eject the air will be wasted unnecessarily.

Figure 7:
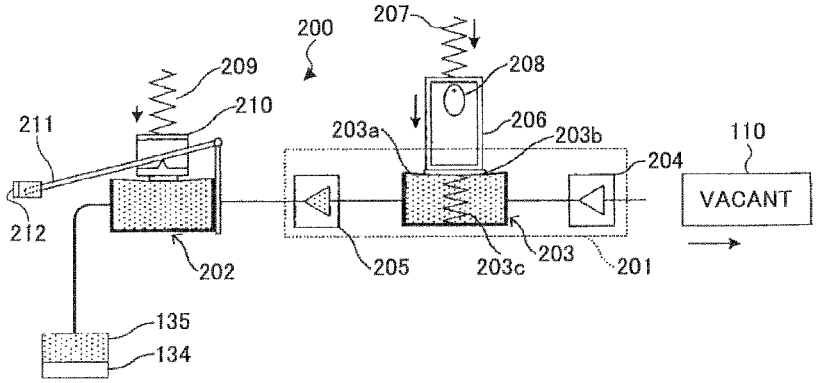
FIG. 7 is a diagram for explaining an appropriate operation of the ink supply device as the liquid supply device according to the embodiment upon occurrence of an ink end state.

FIG. 7 is a diagram for explaining an appropriate operation of the ink supply device as the liquid supply device according to the embodiment upon occurrence of an ink end state. As shown in FIG. 7, if the stop position of the cam 208 is the bottom dead center, the pressing member 206 presses the diaphragm 203 downward via the pump seat 203*b*. Even if the vacant ink cartridge 110 is removed for replacement with the new one, the negative pressure state in the ink passage of the diaphragm pump 201 is maintained. Moreover, if the ink cartridge 110 which is not vacant is removed, the negative pressure state in the ink passage of the diaphragm pump 201 is similarly maintained. Accordingly, external air does not enter the ink passage of the diaphragm pump 201.

Figure 8A:
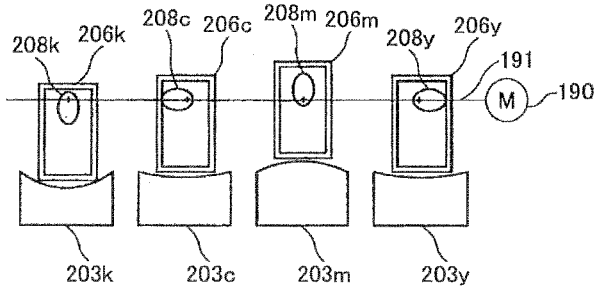
FIGS. 8A to 8C are diagrams showing a cam drive mechanism of an ink supply device as a comparative example.
Figure 8B:
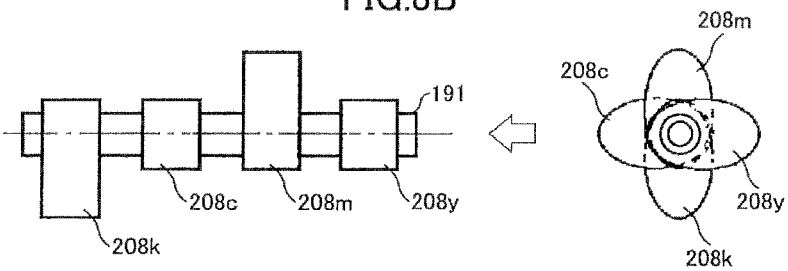
Figure 8C:
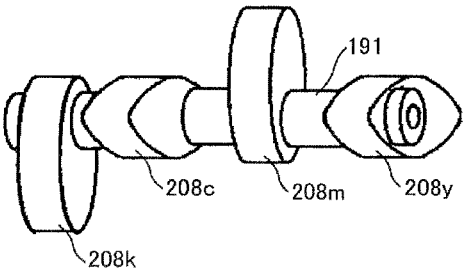

FIGS. 8A to 8C are diagrams showing a cam drive mechanism of an ink supply device as a comparative example. As shown in FIGS. 8A to 8C, four cams 208*k*, 208*c*, 208*m* and 208*y* of four diaphragm pumps (not illustrated) corresponding to the 4-color recording heads (not illustrated) are disposed in tandem on a peripheral surface of a rotating shaft 191 of a drive motor 190 at intervals of a predetermined distance along the rotating shaft 191, and the adjoining cams of the cams 208*k*, 208*c*, 208*m* and 208 are arranged to have a 90-degree phase difference around the rotating shaft 191 when viewed from the axial direction of the rotating shaft 191. The ink supply device with the above-described cam drive mechanism is capable of moving a pressing member corresponding to a target diaphragm pump among the four diaphragm pumps to a predetermined position to regulate the increase in the volume of the diaphragm by the pressing member, and capable of stopping the pressing member while being placed in the predetermined position.

However, in the arrangement of the cam drive mechanism in the comparative example shown in FIGS. 8A to 8C, only the pressurizing pump 203*k* of the diaphragm pump corresponding to the cam 208*k* can be operated and other pressurizing pumps 203*c*-203*y* cannot be operated. Hence, in a case where plural ink cartridges become vacant in the inkjet recording apparatus 1, if one of the ink cartridges corresponding to the diaphragm pump in which the increase in the volume of the diaphragm is not regulated is removed, the negative pressure state of the diaphragm pump is cancelled and external air will enter the ink passage of the diaphragm pump.

Accordingly, in order to eliminate the above-described problem, the ink supply device according to the embodiment is adapted to selectively move a pressing member corresponding to a target diaphragm pump among the plural diaphragm pumps to the predetermined position, and adapted to simultaneously move the respective pressing members corresponding to all of the plural diaphragm pumps to the predetermined positions.

Figure 9A:
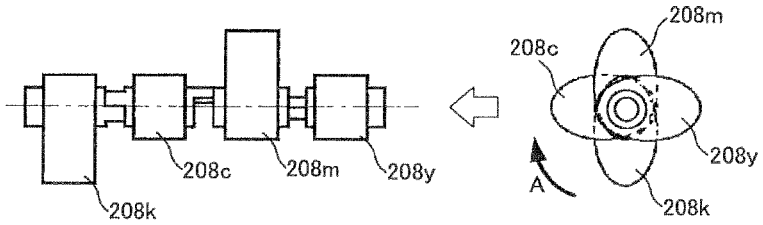
FIGS. 9A to 9C are diagrams showing a cam drive mechanism of the ink supply device as the liquid supply device according to the embodiment when a rotating shaft is rotated in one of two directions.
Figure 9B:
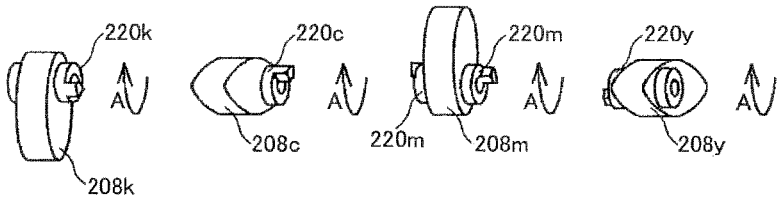
Figure 9C:
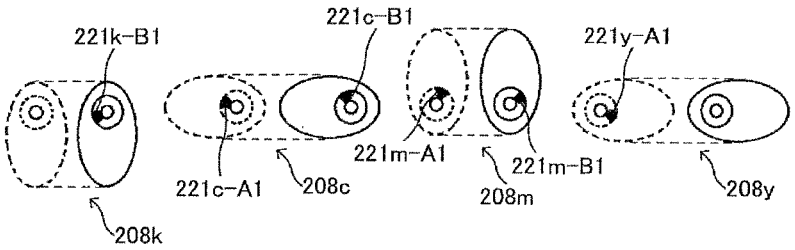

FIGS. 9A to 9C are diagrams showing a cam drive mechanism of the ink supply device as the liquid supply device according to the embodiment when the rotating shaft is rotated in the forward direction. As shown in FIGS. 9A to 9C, the cams 208*k*, 208*c*, 208*m* and 208*y* of the four diaphragm pumps (not illustrated) corresponding to the 4-color recording heads (not illustrated) are disposed in tandem on the peripheral surface of the rotating shaft of the drive motor (not illustrated) at intervals of a predetermined distance along the rotating shaft. Each of the four cams 208*k*-208*y* includes a pair of couplers 220 on the right and left sides of the cam, and the four cams 208*k*-208*y* are connected together through the mutually opposed couplers 220 of the adjacent cams. The couplers 220 of each cam include base portions formed on the sides of the cam and extending in a direction perpendicular to the rotating shaft, and contact portions formed on the base portions and extending in mutually opposite directions parallel to the rotating shaft. Each of the contact portions includes mutually opposed first and second contact surfaces formed on the sides of the contact portion. The cams 208*k*, 208*c*, 208*m* and 208*y* are rotatably supported on the rotating shaft. For example, the cam 208*k* is provided with a locking part (not illustrated) which is engaged with the rotating shaft. When the rotating shaft is rotated in the forward rotation indicated by the arrow A in FIGS. 9A and 9B, the drive force generated by the rotation of the rotating shaft is transmitted to the cam 208*k* via the locking part. Alternatively, the cam 208*y* may be provided with a locking part for the same purpose.

When the rotating shaft is rotated in the forward rotation indicated by the arrow A in FIG. 9A (which direction is viewed from the axial direction of the rotating shaft as shown in FIG. 9A), the cams 208*k*, 208*c*, 208*m* and 208*y* are connected to one another through the mutually opposed couplers 220 of the adjoining cams. As shown in FIGS. 9B and 9C, a first contact surface 221*k*-B1 of a coupler 220*k* of the cam 208*k* and a second contact surface 221*c*-A1 of a coupler 220*c* of the cam 208*c* are in contact with each other. A first contact surface 221*c*-B1 of the coupler 220*c* of the cam 208*c* and a second contact surface 221*m*-A1 of a coupler 220*m* of the cam 208*m* are in contact with each other. A first contact surface 221*m*-B1 of the coupler 220*m* of the cam 208 and a second contact surface 221*y*-A1 of a coupler 220*y* of the cam 208*y* are in contact with each other. As shown in FIGS. 9A-9C, the cams 208*k*, 208*c*, 208*m* and 208*y* are connected together through the mutually opposed couplers 220 of the adjoining cams, and the adjoining cams of the cams 208*k*, 208*c*, 208*m* and 208*y* are arranged to have a 90-degree phase difference around the rotating shaft when viewed from the axial direction of the rotating shaft. Therefore, the ink supply device as the liquid supply device according to the embodiment is adapted to selectively move a pressing member corresponding to a target diaphragm pump among the plural diaphragm pumps to a predetermined position.

Figure 10A:
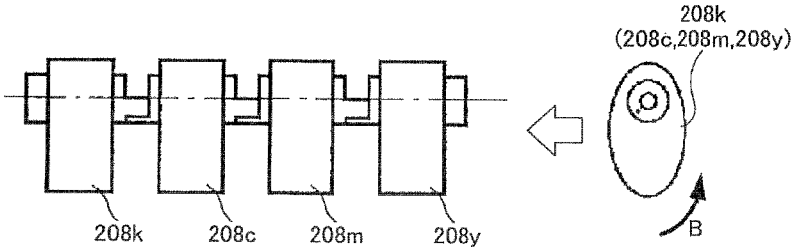
FIGS. 10A to 10C are diagrams showing a cam drive mechanism of the ink supply device as the liquid supply device according to the embodiment when the rotating shaft is rotated in the other direction.
Figure 10B:
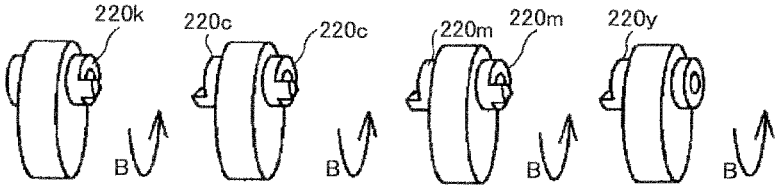
Figure 10C:
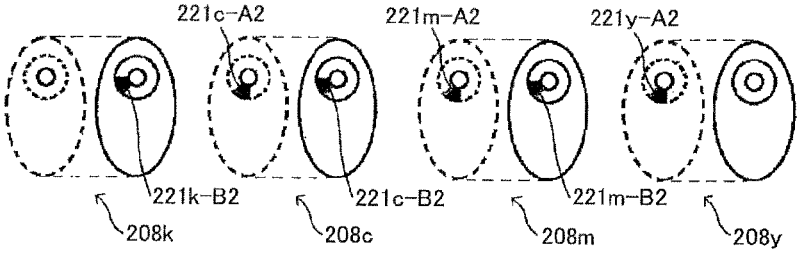

FIGS. 10A to 10C are diagrams showing a cam drive mechanism of the ink supply device as the liquid supply device according to the embodiment when the rotating shaft is rotated in the other direction (the backward direction). For example, the cam 208*k* is provided with a locking part (not illustrated) which is engaged with the rotating shaft. When the rotating shaft is rotated in the other direction (the backward direction) indicated by the arrow B in FIGS. 10A and 10B, the drive force generated by the rotation of the rotating shaft is transmitted to the cam 208*k* via the locking part.

As shown in FIGS. 10B and 10C, a second contact surface 221*k*-B2 of the coupler 220*k* of the cam 208*k* and a first contact surface 221*c*-A2 of the coupler 220*c* of the cam 208*c* are in contact with each other. A second contact surface 221*c*-B2 of the coupler 220*c* of the cam 208*c* and a first contact surface 221*m*-A2 of the coupler 220*m* of the cam 208*m* are in contact with each other. A second contact surface 221*m*-82 of the coupler 220*m* of the cam 208*m* and a first contact surface 221*y*-A2 of the coupler 220*y* of the cam 208*y* are in contact with each other. As shown in FIGS. 10A to 10C, the cams 208*k*, 208*c*, 208*m* and 208 *y* are connected together through the mutually opposed couplers 220 of the adjoining cams, and all of the cams 208*k*, 208*c*, 208*m* and 208*y* are arranged in phase with one another on the peripheral surface of the rotating shaft of the drive motor when viewed from the axial direction of the rotating shaft. Therefore, the ink supply device as the liquid supply device according to the embodiment is adapted to simultaneously move the respective pressing members corresponding to all of the diaphragm pumps to the predetermined positions.

As described above, in the inkjet recording apparatus including the ink supply device as the liquid supply device according to this embodiment, it is possible to prevent air from entering the ink passage of the diaphragm pump even if any ink cartridge among the plural ink cartridges is removed.

Next, an ink supply device as a liquid supply device according to a first modification of the above-described embodiment is explained.

Figure 11A:
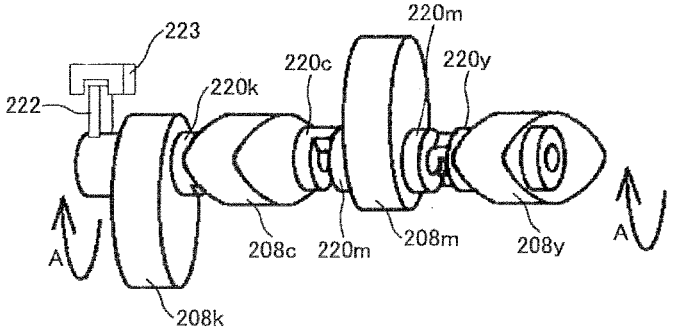
FIGS. 11A and 11B are diagrams showing a configuration of an ink supply device as a liquid supply device according to a first modification.
Figure 11B:
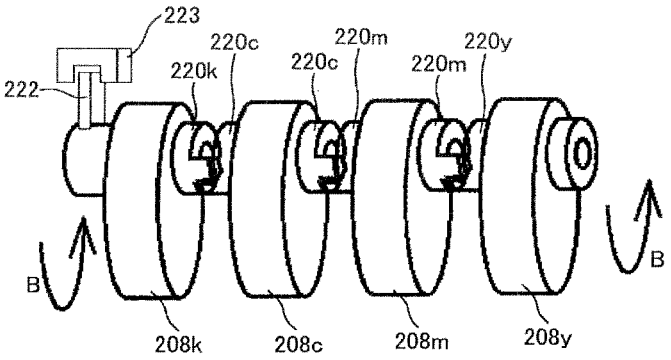

FIGS. 11A and 11B are diagrams showing a configuration of the ink supply device as the liquid supply device according to the first modification.

As shown in FIGS. 11A and 11B, the ink supply device includes a cam detector adapted to detect which of the cams 208*k*, 208*c*, 208*m* and 208*y* corresponds to the diaphragm pump in operation. Specifically, the ink supply device includes a filler 222 disposed on the coupler 220 of the cam 208*k*, and an optical sensor 223 disposed at a predetermined position to detect the presence of the filler 222. As shown in FIG. 11A, if the filler 222 is detected by the optical sensor 223 when the rotating shaft is rotated in the forward direction indicated by the arrow A in FIG. 11A, it can be recognized that the diaphragm pump corresponding to the cam 208*k* is in operation. As shown in FIG. 11B, when the rotating shaft is rotated in the backward direction indicated by the arrow B in FIG. 11B, the optical sensor 223 is controlled to disregard the filler 222. When the four cams 208*k*-208*y* are in phase with one another upon occurrence of an ink end state, a detection signal output by the optical sensor 223 to indicate the presence of the filler 222 is activated. In this case, the cams arrayed in phase with one another may be stopped in the desired positions. Moreover, after the ink end state is detected, the rotating shaft is rotated in the backward direction starting from the state of the cams 208*k*-208*y* shown in FIG. 11A and the rotation of the rotating shaft is continued to obtain a required number of revolutions of the rotating shaft until the state of the cams 208*k*-208*y* shown in FIG. 11B is present. The ink supply device may be adapted to determine that the cams 208*k*-208*y* are located in their bottom dead centers, if the optical sensor 223 outputs a detection signal indicating the presence of the filler 222 consecutively three times in this condition.

Next, an ink supply device as a liquid supply device according to a second modification of the above-described embodiment is explained.

Figure 12A:
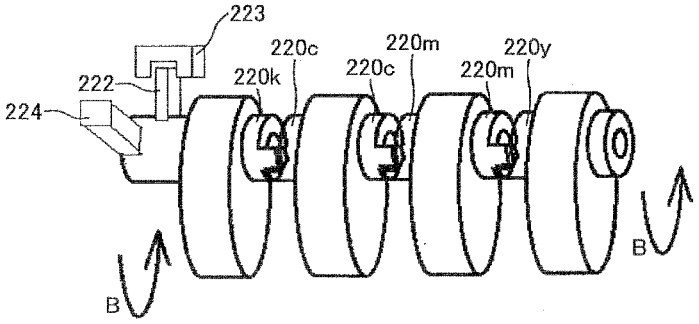
FIGS. 12A and 12B are diagrams showing a configuration of an ink supply device as a liquid supply device according to a second modification.
Figure 12B:
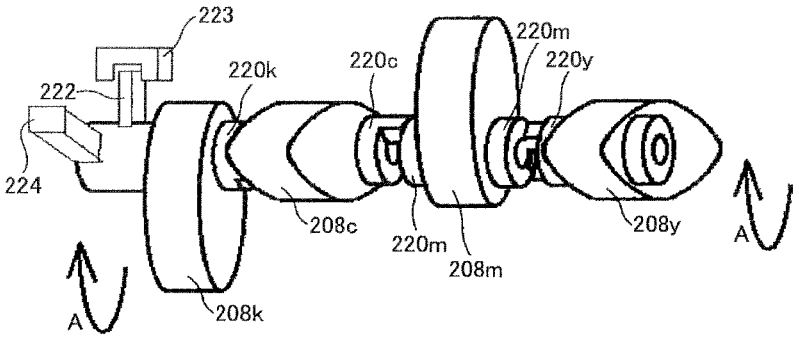

FIGS. 12A and 12B are diagrams showing a configuration of the ink supply device as the liquid supply device according to the second modification.

As shown in FIG. 12A, the ink supply device includes an arm member 224 disposed on the coupler 220 of the cam 208*k*, and a lock mechanism adapted to lock the ink cartridge using the arm member 224, in addition to the filler 222 and the optical sensor 223 in the configuration of the first modification shown in FIGS. 11A and 11B. When the rotating shaft (not illustrated) is rotated in the direction (the forward rotation) indicated by the arrow A in FIG. 12B, the increase in the volume of the diaphragm of the diaphragm pump corresponding to the cam 208*k* is regulated and removal of the ink cartridges other than the ink cartridge 110*k* may be prevented by the lock mechanism. When the rotating shaft (not illustrated) is rotated in the direction (the backward rotation) indicated by the arrow B in FIG. 12A and the state in which the increase in the volume of the diaphragms of all the diaphragm pumps is regulated is reached, the locking of the other ink cartridges by the lock mechanism is cancelled and all the ink cartridges may be freely detached.

Figure 13A:
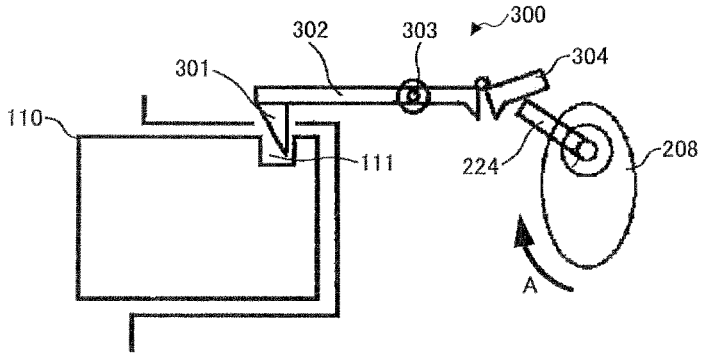
FIGS. 13A and 13B are diagrams showing an example of a lock mechanism.
Figure 13B:
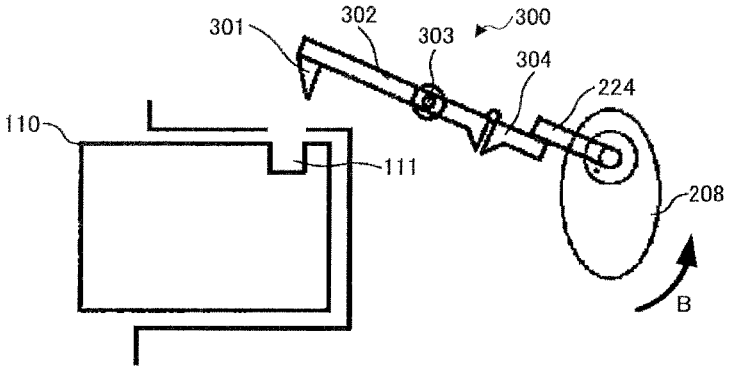

An example of the lock mechanism of the second modification is explained. FIGS. 13A and 13B are diagrams showing a configuration of a lock mechanism 300 in the ink supply device as the liquid supply device according to the second modification.

As shown in FIGS. 13A and 13B, the lock mechanism 300 includes a first lock link 302 in which a locking part 301 which is engaged with or disengaged from a recess 111 formed in a casing of the ink cartridge 110 is disposed at an end portion of the first lock link 302. The first lock link 302 is pivoted to a fulcrum part 303. The lock mechanism 300 further includes a second lock link 304 separate from the first lock link 302, and this second lock link 304 is rotatably supported by an end portion of the first lock link 302 which is opposite to the locking part 301 with respect to the fulcrum part 303. The first and second lock links 302 and 304 are arranged so that, when the second lock link 304 is pressed downward by the arm member 224 in the direction indicated by the arrow B in FIG. 13B, the first lock link 302 is rotated upward around the fulcrum part 303, and when the second lock link 304 is pressed upward by the arm member 224 in the direction indicated by the arrow A in FIG. 13A, the rotation of the first lock link 302 around the fulcrum part 303 is disabled.

Specifically, as shown in FIG. 13A, when the rotating shaft (not illustrated) is rotated in the direction indicated by the arrow A in FIG. 13A (the forward rotation), the second lock link 304 cannot connect with the first lock link 302 even if the arm member 224 is connected to the second lock link 304, and the locking part 301 is not separated from the recess 111 of the ink cartridge 110. Hence, the locked condition of the ink cartridge 110 is continued and the ink cartridge 110 may not be freely detached.

As shown in FIG. 13B, when the rotating shaft (not illustrated) is rotated in the direction indicated by the arrow B in FIG. 13B (the backward rotation), the arm member 224 connects with the second lock link 304 and the second lock link 304 connects with the first lock link 302. The first lock link 302 is rotated upward around the fulcrum part 303 and the locking part 301 is separated from the recess 111 of the ink cartridge. Hence, the locked condition of the ink cartridge 110 by the lock mechanism 300 is cancelled and the ink cartridge 110 may be freely detached.

Figure 14A:
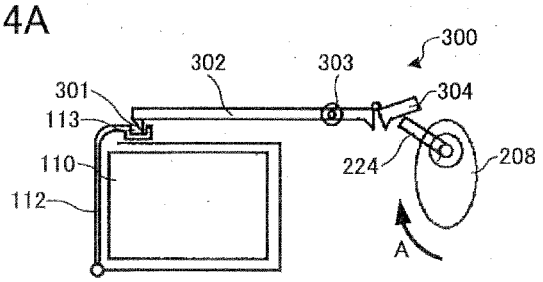
FIGS. 14A to 14C are diagrams showing another example of the lock mechanism.
Figure 14B:
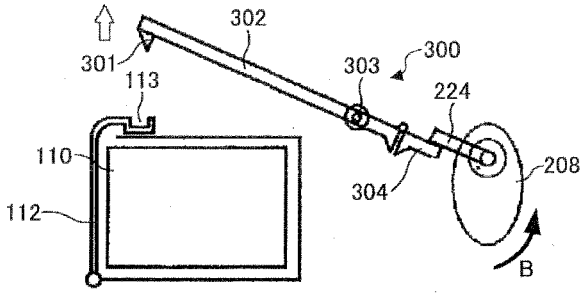
Figure 14C:
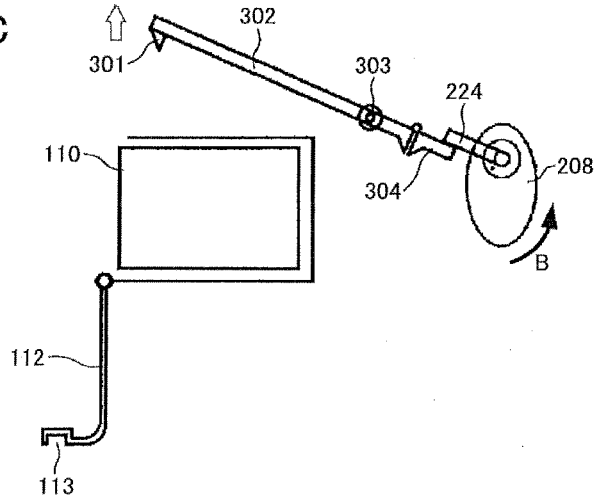

FIGS. 14A to 14C are diagrams showing a configuration of another example of the lock mechanism 300.

As shown in FIGS. 14A to 14C, the lock mechanism 300 includes a locking part 301 which is engaged with or disengaged from a recess 113 formed in an exterior cover 112 in the ink cartridge loading portion (not illustrated) for the ink cartridge 110. As shown in FIG. 14A, when the rotating shaft (not illustrated) is rotated in the direction indicated by the arrow A in FIG. 14A (the forward rotation), the second lock link 304 cannot connect with the first lock link 302 even if the arm member 224 is connected to the second lock link 304, and the locking part 301 is not separated from the recess 113 of the exterior cover 112 of the ink cartridge loading portion. Hence, the locked condition of the ink cartridge 110 by the lock mechanism 300 is continued and the ink cartridge may not be freely detached from the ink cartridge loading portion.

As shown in FIGS. 14B and 14C, when the rotating shaft (not illustrated) is rotated in the direction indicated by the arrow B in FIGS. 14B and 14C (the backward rotation), the arm member 224 connects with the second lock link 304 and the locking part 301 is separated from the recess 113 of the exterior cover 112 of the ink cartridge loading portion 104. Thereby, the locked condition of the ink cartridge by the lock mechanism is cancelled and the ink cartridge may be freely detached from the ink cartridge loading portion 104.

Next, an ink supply device as a liquid supply device according to a third modification of the above-described embodiment is explained.

Figure 15A:
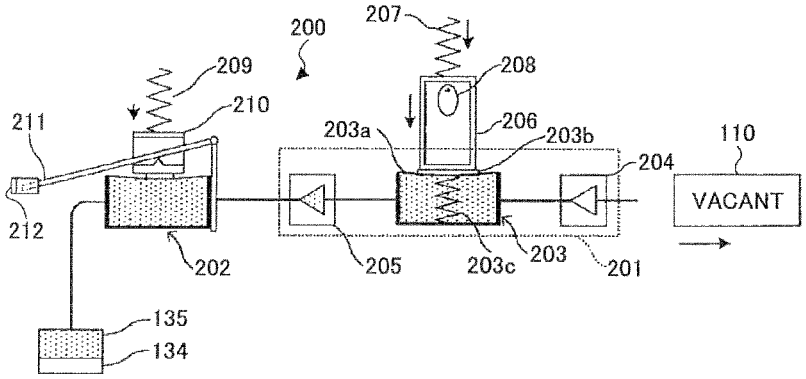
FIGS. 15A and 15B are diagrams showing a configuration of an ink supply device as a liquid supply device according to a third modification.
Figure 15B:
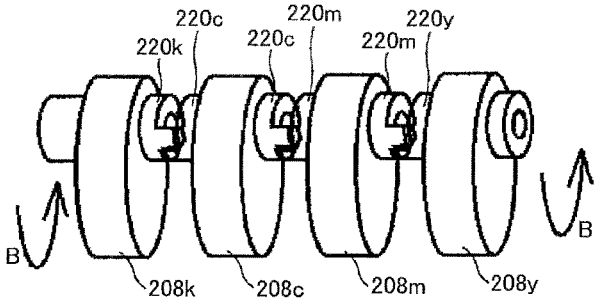
Figure 16A:
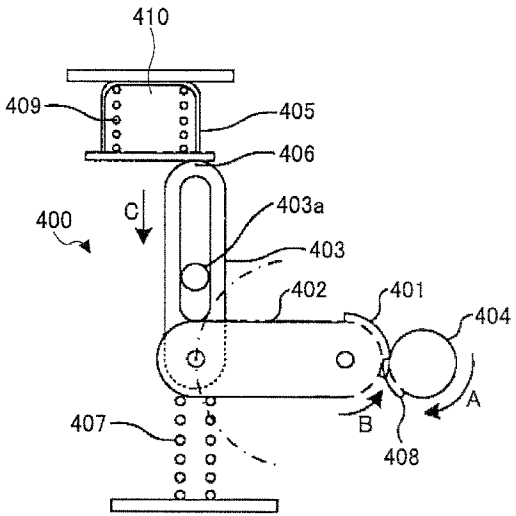
FIG.16A RELATED ART
FIGS. 16A to 16D are diagrams for explaining operation of a pump drive device according to the related art.
Figure 16B:
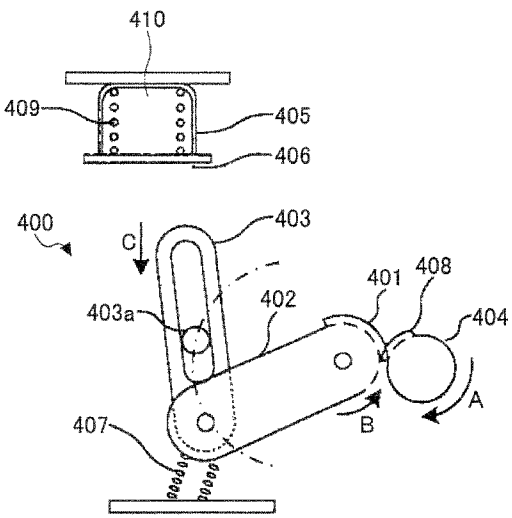
FIG.16B RELATED ART
Figure 16C:
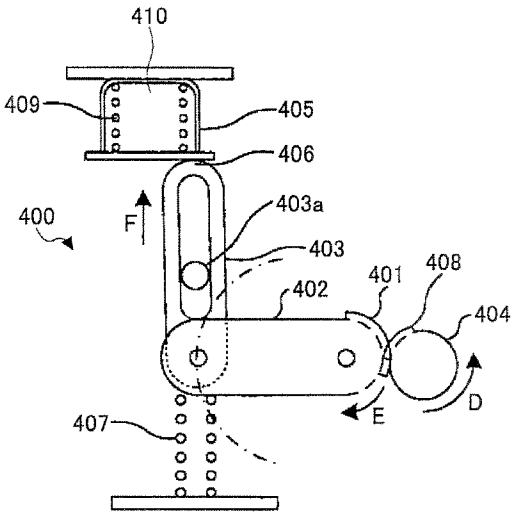
FIG.16C RELATED ART
Figure 16D:
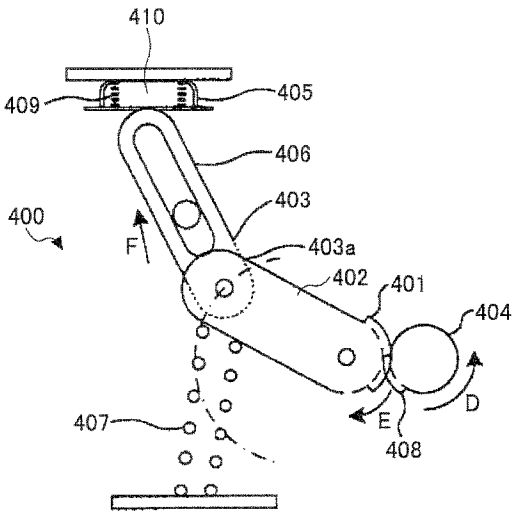
FIG.16D RELATED ART

FIGS. 15A to 15C are diagrams showing a configuration of the ink supply device as the liquid supply device according to the third embodiment.

As shown in FIG. 15A, if the tip of the ink end detection filler 211 is detected by the optical sensor 212 and an ink end state of at least one of the ink cartridges is detected, the rotating shaft (not illustrated) is rotated in the direction indicated by the arrow B in FIG. 15B (the backward rotation), so that all of the cams 208*k*, 208*c*, 208*m* and 208*y* are arranged in phase with one another at their bottom dead centers. Hence, the pressing members 206 corresponding to the diaphragms of all of the plural diaphragm pumps corresponding to the cams may be simultaneously moved to the predetermined positions, and the increase in the volume of the diaphragms of all the diaphragm pumps is regulated, any of the ink cartridges 110 may be freely detached.

All examples and conditional language provided herein are intended for the purposes of aiding the reader in understanding the invention and the concepts contributed by the inventors to further the art and are not to be construed as limitations to such specifically recited examples and conditions, nor does the organization of such examples in the specification relate to a showing of the superiority and inferiority of the invention.

Example 1

The liquid supply device of this example includes the plurality of diaphragms 203*a* as a plurality of liquid holding parts each holding liquid, formed of an elastically deformable material, and adapted to be increased in a volume of the liquid holding part by an outward actuation force of a spring provided in the liquid holding part; the plurality of pressing members 206 as a plurality of regulation units each adapted to regulate an increase in a volume of a corresponding one of the plurality of diaphragms 203*a*; the movement unit adapted to move the plurality of pressing members 206 to a position where the increase in the volume of at least one of the plurality of diaphragms 203*a* is regulated by the plurality of pressing members 206; the rotating shaft 191 adapted to be rotated in one of first and second directions; and the plurality of cams 208 as a plurality of drive transmission units disposed on a peripheral surface of the rotating shaft 191 in positions corresponding to the plurality of pressing members 206, wherein the movement unit is adapted to: move the plurality of cams 208 as the plurality of drive transmission units when the rotating shaft 191 is rotated in the first direction so that adjoining ones of the plurality of drive transmission units are arranged to have a phase difference around the rotating shaft 191 when viewed from an axial direction of the rotating shaft 191, wherein one of the plurality of pressing members 206 selectively causes a corresponding one of the plurality of cams 208 to regulate the increase in the volume of a corresponding one of the plurality of diaphragms 203*a*; and move the plurality of cams 208 as the plurality of drive transmission units when the rotating shaft 191 is rotated in the second direction so that the plurality of cams 208 are arranged in phase with one another when viewed from the axial direction of the rotating shaft 191, wherein the plurality of cams 208 causes all the plurality of pressing members 206 to simultaneously regulate the increase in the volume of each of the plurality of diaphragms 203*a*.

As previously explained in the foregoing embodiment, the internal space of the diaphragm 203*a* becomes a negative pressure by a decrease of the volume. Hence, in a condition in which the increase in the volume of the diaphragm 203*a* is not regulated by the pressing member 206, if the ink tank is removed, external air may be attracted into the diaphragm 203*a* due to the negative pressure therein. To eliminate the problem, according to the liquid supply device of this example, the cams 208 are moved when the rotating shaft 191 is rotated in the first direction so that the adjoining ones of the cams 208 are arranged to have a phase difference around the rotating shaft 191 when viewed from the axial direction of the rotating shaft 191, wherein one of the cams 208 selectively causes the corresponding one of the pressing members 206 to regulate the increase in the volume of the target diaphragms 203*a* of the plurality of diaphragms 203*a*. Moreover, the cams 208 are moved when the rotating shaft 191 is rotated in the second direction so that the cams 208 are arranged in phase with one another when viewed from the axial direction of the rotating shaft 191, wherein the cams 208 simultaneously cause all the pressing members 206 to regulate the increase in the volume of each of the diaphragms 203*a*. Accordingly, even when any of the ink cartridges 110 is removed, it is possible to prevent attraction of air into the diaphragms 203*a* due to a negative pressure.

Example 2

In the liquid supply device of Example 1, the plurality of drive transmission units are implemented by the plurality of cams 208, each of the plurality of cams 208 including first and second couplers 220 on left and right sides of the cam, and each of the first and second couplers 220 including mutually opposed first and second contact surfaces. In the liquid supply device of Example 1, when the rotating shaft 191 is rotated in the first direction, the plurality of cams 208 are connected together through the first and second couplers 220 of the adjoining cams in which the first contact surface 221*c*-A1, 221*m*-A1, or 221*y*-A1 of the second coupler 220 of one of the adjoining cams and the second contact surface 221*k*-B1, 221*c*-81, or 221*m*-B1 of the first coupler 220 of the other of the adjoining cams are in contact with each other. Moreover, in the liquid supply device of Example 1, when the rotating shaft 191 is rotated in the second direction, the plurality of cams 208 are connected together through the first and second couplers 220 of the adjoining cams in which the second contact surface 221*c*-A2, 221*m*-A2, or 221*y*-A2 of the second coupler 220 of one of the adjoining cams and the first contact surface 221*k*-B2, 221*c*-82, or 221*m*-B2 of the first coupler 220 of the other of the adjoining cams are in contact with each other. According to the liquid supply device of this example, as described above in the foregoing embodiment, when the rotating shaft 191 is rotated in the first direction, the cams 208 on the peripheral surface of the rotating shaft 191 are arranged so that the adjoining ones of the cams 208 have a phase difference around the rotating shaft 191, and when the rotating shaft 191 is rotated in the second direction, the cams 208 are arranged in phase with one another. Hence, the connection of the plurality of cams 208 may be easily switched between the two modes of the cam arrangement.

Example 3

The liquid supply device of Example 2 further includes the optical sensor 223 adapted to detect presence of the filler 222 disposed on the first coupler of one of the plurality of cams 208, wherein the liquid supply device is adapted to determine whether the plurality of cams 208 after the rotating shaft 191 is rotated in the second direction are located at their bottom dead centers. According to the liquid supply device of this example, as described above in the first modification, it is possible to detect by the optical sensor 223 that the plurality of cams 208 are arranged in phase at their bottom dead centers upon occurrence of the ink end state, and it is possible to stop the plurality of cams 208 arranged in phase with one another by using the detection signals of the optical sensor 223 suitably.

Example 4

The inkjet recording apparatus 1 as the image forming apparatus of this example includes the plurality of ink cartridges 110 as a plurality of ink tanks each adapted to hold ink; the plurality of recording heads 134 each adapted to eject ink to a recording medium; the plurality of head tanks 135 connected to the plurality of ink cartridges 110 respectively, each adapted to hold ink to be supplied to one of the plurality of recording heads 134; and the ink supply device as the liquid supply device adapted to supply the ink from the plurality of ink cartridges 110 to the plurality of head tanks 135, wherein the image forming apparatus forms an image on a recording medium using the plurality of recording heads 134 and the ink supply device includes the plurality of diaphragms 203*a* as a plurality of liquid holding parts each holding liquid, formed of an elastically deformable material, and adapted to be increased in a volume of the liquid holding part by an outward actuation force of a spring provided in the liquid holding part; the plurality of pressing members 206 as a plurality of regulation units each adapted to regulate an increase in a volume of a corresponding one of the plurality of diaphragms 203*a*; the movement unit adapted to move the plurality of pressing members 206 to a position where the increase in the volume of at least one of the plurality of diaphragms 203*a* is regulated by the plurality of pressing members 206; the rotating shaft 191 adapted to be rotated in one of first and second directions; and the plurality of cams 208 as a plurality of drive transmission units disposed on a peripheral surface of the rotating shaft 191 in positions corresponding to the plurality of pressing members 206, wherein the movement unit is adapted to: move the plurality of cams 208 as the plurality of drive transmission units, when the rotating shaft 191 is rotated in the first direction, so that adjoining ones of the plurality of drive transmission units are arranged to have a phase difference around the rotating shaft 191 when viewed from an axial direction of the rotating shaft 191, wherein one of the plurality of pressing members 206 selectively causes a corresponding one of the plurality of cams 208 to regulate the increase in the volume of a corresponding one of the plurality of diaphragms 203*a*; and move the plurality of cams 208 as the plurality of drive transmission unit, when the rotating shaft 191 is rotated in the second direction, so that the plurality of cams 208 are arranged in in phase with one another when viewed from the axial direction of the rotating shaft 191, wherein the plurality of cams 208 simultaneously cause all the plurality of pressing members 206 to regulate the increase in the volume of each of the plurality of diaphragms 203*a*. According to the image forming apparatus of this example, as described above in the foregoing embodiment, the increase in the pump internal volume of each of the diaphragms 203*a* of the diaphragm pumps 201 in the inkjet recording apparatus 1 may be simultaneously regulated, and it is possible to prevent attraction of air into the diaphragms 203*a* due to a negative pressure even when any of the ink cartridges 110 is removed.

Example 5

The image forming apparatus of Example 4 further includes the lock mechanism 300 as an ink tank lock mechanism adapted to lock at least one of the plurality of ink cartridges 110 as the plurality of ink tanks using the arm member 224 disposed on the plurality of cams 208 as the plurality of drive transmission units. According to the image forming apparatus of this example, as described above in the second modification, it is possible to prevent attraction of air into the diaphragm pumps 201 due to a negative pressure even when any of the ink cartridges 110 is removed.

Example 6

The image forming apparatus of Example 4 further includes the lock mechanism 300 as a lock mechanism adapted to lock the exterior cover 112 as a cover member that covers an opening of the ink cartridge loading portion 104 in which the plurality of ink cartridges 110 are loaded. According to the image forming apparatus of this example, as described above in the second modification, it is possible to prevent attraction of air into the diaphragm pumps 201 due to a negative pressure even when any of the ink cartridges 110 is removed.

Example 7

The image forming apparatus of Example 4 further includes the ink end detection filler 211 and the optical sensor 212 as a detection unit adapted to detect an ink end state of at least one of the plurality of ink tanks in which a quantity of the remaining ink in the at least one of the plurality of ink tanks is less than a predetermined quantity. According to the image forming apparatus of this example, as described above in the third modification, if the ink end state of at least one of the ink cartridges 110 is detected, the rotating shaft 191 is rotated in the second direction and the plurality of cams 208 are arranged in phase with one another and in parallel with the axial direction of the rotating shaft 191. Hence, the increase in the volume of each of the diaphragms 203*a* may be simultaneously regulated by all the plurality of pressing members 206 corresponding to the plurality of cams 208.

As described in the foregoing, it is possible for the liquid supply device according to the present invention to regulate simultaneously the increase in the volume of each of the plurality of liquid holding parts and to prevent attraction of air into the liquid holding parts due to a negative pressure.

The liquid supply device according to the present invention is not limited to the above-described embodiments, and variations and modifications may be made without departing from the scope of the present invention.

The present application is based upon and claims the benefit of priority of Japanese Patent Application No. 2013-190612, filed on Sep. 13, 2013, the contents of which are incorporated herein by reference in their entirety.

What is claimed is:

1. A liquid supply device comprising:

a plurality of liquid holding parts each holding liquid, formed of an elastically deformable material, and adapted to be increased in a volume of the liquid holding part by an outward actuation force of a spring provided in the liquid holding part;

a plurality of regulation units each adapted to regulate an increase in a volume of a corresponding one of the plurality of liquid holding parts;

a movement unit adapted to move the plurality of regulation units to a position where the increase in the volume of at least one of the plurality of liquid holding parts is regulated by the plurality of regulation units;

a rotating shaft adapted to be rotated in one of first and second directions; and a plurality of drive transmission units disposed on a peripheral surface of the rotating shaft in positions corresponding to the plurality of regulation units, wherein the movement unit is adapted to:

move the plurality of drive transmission units when the rotating shaft is rotated in the first direction so that adjoining ones of the plurality of drive transmission units are arranged to have a phase difference around the rotating shaft when viewed from an axial direction of the rotating shaft, wherein one of the plurality of drive transmission units selectively causes a corresponding one of the plurality of regulation units to regulate the increase in the volume of a corresponding one of the plurality of liquid holding parts; and move the plurality of drive transmission units when the rotating shaft is rotated in the second direction so that the plurality of drive transmission units are arranged in phase with one another when viewed from the axial direction of the rotating shaft, wherein the plurality of drive transmission units simultaneously cause all the plurality of regulation units to regulate the increase in the volume of each of the plurality of liquid holding parts.

2. The liquid supply device according to claim 1, wherein the plurality of drive transmission units are implemented by a plurality of cams, each of the plurality of cams includes first and second couplers on left and right sides of the cam, and each of the first and second couplers includes mutually opposed first and second contact surfaces, and wherein, when the rotating shaft is rotated in the first direction, the plurality of cams are connected together through the first and second couplers of the adjoining cams in which the first contact surface of the second coupler of one of the adjoining cams and the second contact surface of the first coupler of the other of the adjoining cams are in contact with each other, and when the rotating shaft is rotated in the second direction, the plurality of cams are connected together through the first and second couplers of the adjoining cams in which the second contact surface of the second coupler of one of the adjoining cams and the first contact surface of the first coupler of the other of the adjoining cams are in contact with each other.

3. The liquid supply device according to claim 2, further comprising an optical sensor adapted to detect presence of a filler disposed on the first coupler of one of the plurality of cams, wherein the liquid supply device is adapted to determine whether the plurality of cams after the rotating shaft is rotated in the second direction are located at their bottom dead centers.

4. An image forming apparatus including:

a plurality of ink tanks each adapted to hold ink;

a plurality of recording heads each adapted to eject ink to a recording medium;

a plurality of head tanks connected to the plurality of ink tanks respectively, each adapted to hold ink to be supplied to one of the plurality of recording heads; and an ink supply device adapted to supply the ink from the plurality of ink tanks to the plurality of head tanks, wherein the image forming apparatus forms an image on a recording medium using the plurality of recording heads and the liquid supply device comprises:

a plurality of liquid holding parts each holding liquid, formed of an elastically deformable material, and adapted to be increased in a volume of the liquid holding part by an outward actuation force of a spring provided in the liquid holding part;

a plurality of regulation units each adapted to regulate an increase in a volume of a corresponding one of the plurality of liquid holding parts;

a movement unit adapted to move the plurality of regulation units to a position where the increase in the volume of at least one of the plurality of liquid holding parts is regulated by the plurality of regulation units;

a rotating shaft adapted to be rotated in one of first and second directions; and a plurality of drive transmission units disposed on a peripheral surface of the rotating shaft in positions corresponding to the plurality of regulation units, wherein the movement unit is adapted to:

move the plurality of drive transmission units when the rotating shaft is rotated in the first direction so that adjoining ones of the plurality of drive transmission units are arranged to have a phase difference around the rotating shaft when viewed from an axial direction of the rotating shaft, wherein one of the plurality of drive transmission units selectively causes a corresponding one of the plurality of regulation units to regulate the increase in the volume of a corresponding one of the plurality of liquid holding parts; and move the plurality of drive transmission units when the rotating shaft is rotated in the second direction so that the plurality of drive transmission units are arranged in phase with one another when viewed from the axial direction of the rotating shaft, wherein the plurality of drive transmission units simultaneously cause all the plurality of regulation units to regulate the increase in the volume of each of the plurality of liquid holding parts.

5. The image forming apparatus according to claim 4, further comprising:

an ink tank lock mechanism adapted to lock at least one of the plurality of ink tanks using an arm member disposed on the plurality of drive transmission units.

6. The image forming apparatus according to claim 4, further comprising:

a lock mechanism adapted to lock a cover member that covers an opening of a loading portion in which the plurality of ink tanks is loaded.

7. The image forming apparatus according to claim 4, further comprising:

a detection unit adapted to detect an ink end state of at least one of the plurality of ink tanks in which a quantity of the remaining ink in the at least one of the plurality of ink tanks is less than a predetermined quantity.

* * * * *